US006345662B1

(12) United States Patent
Tahara

(10) Patent No.: US 6,345,662 B1
(45) Date of Patent: Feb. 12, 2002

(54) AUTOMATIC VIBRATION MOLDING MACHINE FOR GREEN SAND MOLD

(75) Inventor: Koji Tahara, Osaka (JP)

(73) Assignee: Taiyo Machinery Co., Ltd., Osaka (JP)

( * ) Notice: Subject to any disclaimer, the term of this patent is extended or adjusted under 35 U.S.C. 154(b) by 0 days.

(21) Appl. No.: 09/452,716

(22) Filed: Dec. 3, 1999

(30) Foreign Application Priority Data

Dec. 4, 1998 (JP) ..... 10-376641

(51) Int. Cl.[7] ..... B22C 15/30
(52) U.S. Cl. ..... 164/197; 164/203; 425/432
(58) Field of Search ..... 425/175, 432, 425/456; 164/197, 203, 204

(56) References Cited

U.S. PATENT DOCUMENTS 4,193,754 A * 3/1980 Sekiguchi ..... 425/432
4,565,232 A * 1/1986 Abraham ..... 164/197

* cited by examiner

*Primary Examiner*—James P. Mackey
(74) *Attorney, Agent, or Firm*—Ronald E. Greigg

(57) ABSTRACT

An automatic vibration molding machine for green sand mold. The green sand of a flask may be compressed and formed by the pressure force of expansion of pressure air-spring means and the vibration force of vibration motor mounted on the vibration head, as well as the vibration which is propagated to a pattern from an upper frame via a lower frame, an ascent and descent cylinder, and an ascent and descent table.

8 Claims, 6 Drawing Sheets

AUTOMATIC VIBRATION MOLDING MACHINE FOR GREEN SAND MOLD

BACKGROUND OF THE INVENTION (1) Field of the Invention

This invention relates to an automatic vibration molding machine for green sand molding for casting.

(2) Prior Art

Conventionally, adopted types of green sand molding machines are roughly divided into three, i.e., a jolt type, a squeeze type and a blow type.

A jolt type green sand molding machine comprises a flask placed on a table of a molding machine in which sand is filled, an air cylinder installed under the table to which compressed air is blown, and a piston combined with the table. The piston is blown up together with the table by the compressed air, and the table falls free by exhausting air at a certain level of height. Then, the table and the cylinder collide with each other and the sand in the flask is squeezed down toward the pattern underneath by innertial force of the sand itself. Thus, the jolt type is provided with a basic mechanism of a conventional green sand molding machine.

The squeeze type green sand molding machine comprises a mechanin which the green sand in a flask is pressed downward into the flask by a pnewmatics by an air cylinder or oil hyraulics (instead of these means there are means using a diaphragm). Both driving types, in anyway, use a pressure plate whose size is a little smaller than the inner size of the flask (The cylinder and the pressure plate can be plural).

Otherwise, the squeeze type green sand molding machine is provided with a squeeze mechanism in which a flask filled with green sand on the pattern is raised by compressed air or oil hyraulics of a squeeze cylinder together with the table of the upper part of a cylinder toward the pressure plate which is fixed above the flask.

The blow type is a method of filling green sand in a space between the pattern of the flask and the pressure plate by utilizing an air flow. It is known that there are a blow-in and pressure type and a decompression and vaccum type.

The above-mentioned conventional green sand molding machine is a combination of a main mechanism for clamping a flask and a drafting mechanism for separating the clamped flask and the pattern (a stripper type in which a flask is drafted upward from the fixed pattern and a pattern-draw type in which the pattern is drafted downward from the fixed flask), and various types of molding mechines such as a flask type, and a snap flask type in which the flask is installed in the molding machine.

In the molding machine simply having functions of a jolt type and a squeeze type, a match plate of upper and undersurface type as a pattern is used and a tapered snap flask is also used, and it is carried out that first of all, a drag is formed and reversed and its cope is formed, and their draft is also carried out manually. In this manual work, it is advantageous that skillful arrangement is made according to the experience of an operator, so as to accommodate complex molds. However, there are such disadvantages that in molding the manual operation needs a great effort for reversing both of the cope and the drag simultenously, drafting and also for lifting the flask and the pattern by hands. As a result, such skillful operators, who may use this type of molding machine, have become reduced year by year.

Further, the flask is limitted to such a flask of small type which may be delt with hands, and the actions of jolt type generates metallic sounds and vibrations due to fall and strike of a table to cause sometimes break of the table, and also there may be raised a problem of working environment due to propagation of vibrations from the molding machine to the operator via the floor.

Where such a molding machine having functions of jolt type and squeeze type provides a draft function of stripper (or pattern-draw), the flask may be adapted for a mold of middle size since it is not necessary to hand the flask, and it is seldom to use a snap flask. Therefore, such a molding machine is normally operated in semi-automatic operation and therefore it is advantageous that it may be used for various purposes with respect to any type of pattern.

However, where the molding machine becomes bigger, the jolt sounds and vibrations become greater, and further since its squeeze pressure becomes several tens of tons, it may increase danger of break of parts of the machine. Further, since it is necessary two patterns for the top flask and the bottom flask, it has to use two molding machines, or it needs a changing mechanism for changing the pattern for the cope and the drag alternately. This causes a disadvantage of cost-up for installation.

Contrary to this, the blow squeeze type, which provides a blow mechanism for filling green sand in the place of a flask while transferring the green sand with an air flow, is normally suitable for a small size mold of mass production that is speedy in molding and a number of molding machines are in a type of snap flask. Further, such a molding machine is worked almost automatically except core setting operations and sometimes the molding machine provides an automatic core setting device.

This type of the molding machine has an advantage of rapidly forming a mold, but it provides direction for filling the green sand with an air flow, and as a result, it raises a problem that it may form a shadow according to the shape of a pattern but cannot give a correction to the portion where filling of the green sand is insufficient.

Further, the pattern wears rapidly with sand blast and as a result, the pattern is frequently made of metalic material and its cost becomes high. Furthermore, it increases consumption of parts for blow operation, so that its maintenance cost also goes up, and the price of such a molding machine becomes high inevitably since an oil pressure device is frequently used for its squeeze operation.

In anyone of the jold type or the squeeze type or its improved type, the processes of filling, pressing and forming of the green sand are carried out at the same place and with a series of flow, and therefore there is no way, but a process for a new flask must be started after completion of molding of a flask. This raises a problem that molding productivity does not go up.

SUMMARY OF THE INVENTION

In view of the above-mentioned problems of the prior art, this invention has an object to provide an automatic vibration molding machine which has a high productivity to present a green sand mold of sufficient compression without using an oil pressure device of high cost as pressure means, and to prevent propagation of vibrations to a floor.

To achieve the above object, an automatic vibration molding machine for green sand mold according to the present invention comprises a plurality of vibration proof springs 5 fixed onto a base 4 which is fixed to a floor, a lower frame 3 set and fixed on the vibration proof springs 5, ascent and descent cylinder means 25 with a lock mechanism fixed to the lower frame 3, an ascent and descent table 23 setting thereon a flaskb filled with green sand therein and constructed to go up and down between an upward pressing and forming position and a downward predetermined position, an upper frame 1 disposed via an intermediate frame 2 positioned standingly on the lower frame 3, a vibration head 11 having at least one vibration motor 10 for vibrating a pressure plate 13 via pressure air spring means 12 expansible and contractible in up and down directions, said vibration head being suspended from the upper frame 1 via a head-ascent and descent frame 17, and ascent and descent means 14 for ascending and descending the vibration head 11 to ascend and descend the pressure plate 13 between an upmost position for separating the pressure plate 13 from the flaskb by contracting the pressure air spring means 12 and a descent position for expanding the pressure air spring means 12 to press the green sand, whereby the green sand of the flaskb may be compressed and formed by the pressure force of expansion of the pressure air spring means 12 and the vibration force of the vibration motor 10 mounted on the vibration head 11, as well as the vibration which is propagated to a pattern c from the upper frame 1 via the lower frame 3, the ascent and descent cylinder 25, and the ascent and descent table 23.

In the present invention, it is preferable that the automatic vibration molding machine further comprises a frame stabilizing device 6 for changably shifting the lower frame 3 between an ascent position for rigidly supporting the lower frame 3 by expanding the vibration proof air springs 5 upwardly and a descent position for descending the lower frame 3 at the time of molding so as to flexibly support the lower frame 3 by means of the vibration proof air springs 5, when the flask b is taken in and taken out of the molding machine, wherein said frame stabilizing device 6 comprises a plurality of cam followers 9 for supporting the lower frame 3 from the beneath thereof, a frame stabilizing cylinder 7 operatively connected to the cam followers 9 to rotate the cam followers 9, and said cam followers 9 are arranged along the sides of the lower frame 3 which are opposite to each other, so as to rotate in opposite directions each other.

Further, it is preferable that the ascent and descent cylinder means 25 with a lock mechanism ascends with oil by means of an air-oil converter 27 and is locked by means of a ball valve 28 as the valve is closed.

Furthermore, it is preferable that a rotary fork 33 for setting the flask b at both end portions thereof to ratate laterally about a vertical axis, said rotary fork 33 being arranged on the base 4, and a green sand supplying station A A and a molding station B, arranged respectively at positions leaving 180 degrees therebetween.

As will be seen from FIG. 6, showing vibration molding, the green sand filled in the flask b increases its fluidity and smoothly goes into shadow portions of the pattern so as to be pressed minutely and to obtain a constant hardness of the mold in a short time by receiving three kinds of force and a vibration which is propagated to the pattern c from the vibration motor via the upper frame 1, the intermediate frame 2, the lower frame 3, the ascent and descent cylinder means 25 and the ascent and descent table 23. Namely, the three kinds of force are pressure forces derived from a dead load of each of the vibration head 11 and the pressure plate 13 in a free state (free fall condition), a pressure force caused by expanding the pressure air spring means 12, and a vibration force caused by the vibration motor 10.

In addition to this, by providing the vibration proof air springs 5, the vibration of the vibration head 11 may prevent a bad influence that the vibration is propagated to the floor and the operator or other implements of the molding machine. Further, since the flask b is positioned and fixed stably in a molding position (ascent) by means of the ascent and descent cylinder means 25 with a lock mechanism, the flask may receive the vibration of the vibration head 11 and the pressure of the pressure air spring means 12, so as to surely carry out minute filling of the green sand.

For reference, the dead load of each of the vibration head 11 and the pressure plate 13 and the pressure caused by expanding the pressure air spring means 12 and the pressure force derived from the vibration force of the vibration motor 10, generate a value of face pressure less than about 2 $kgf/cm^2$(That is about one fifth in comparison with the oil (air) system of the prior art.). However, the present invention obtains a hardness of mold around 90 points. For example, in the oil pressure system of the prior art, it neccessitates a power of generating 10 $kgf/cm^{\pm}5$ $kgf/cm^2$, in order to obtain the said hardness of mold.

In the present invention, at the time of taking the flask b in and out from the molding machine, where the frame stabilizing device 6 is provided for changably shifting the lower frame 3 between an ascent position for rigidly supporting the lower frame 3 by expanding the vibration proof air springs 5 upwardly and a descent position for descending the lower frame 3 at the time of molding so as to flexibly support the lower frame 3 by means of the vibration proof air springs 5, when the flask b is taken in and taken out of the molding machine, wherein said frame stabilizing device 6 comprises a plurality of cam followers 9 for supporting the lower frame 3 from the beneath thereof, a frame stabilizing cylinder 7 operatively connected to the cam followers 9 to rotate the cam followers 9, and said cam followers 9 are arranged along the sides of the lower frame 3 which are opposite to each other, so as to rotate in opposite directions each other, the following functions will be expected.

Namely, as seen from FIG. 5 of descriptive view, the frame stabilizing device 6 becomes possible to change easily and very rapidly the take-in process and the take-out process of the flask other than such a manner of supplying air under pressure to and exhausting air from the vibration proof air springs 5.

Further, instead of descending the lower frame 3 by exhausting air from the vibration proof air springs 5 or contacting the lower frame 3 with the base 4 to place the lower frame 3 to fix its position, fix of its position of the lower frame 3 by ascending the lower frame 3 with cam function, so that it becomes possible not only to change its position rapidly but also smoothly fix its position without shock at the time of its position fixing.

Furthermore, by rotating the cam followers 9 in opposite directions with each other, it is not afraid that the cam followers 9 are rotated reversely and downwardly due to any vibration or load from the upward, since the cam followers 9 are fixed after they passed each of the dead points in different directions. Therefore, the lower frame 3 may be supported in a state that they are mechanically stable.

Further, where the ascent and descent cylinder means 25 with a lock mechanism ascends with oil by means of an air-oil converter 27 and is locked by means of a ball valve 28 as the valve is closed, the ascent and descent cylinder may be locked rigidly by a lock of the oil pressure circuit while using air as a power source of its operation, and as a result, the locking operation may be surely carried out while saving its manufacturing cost.

In addition to this, where a rotary fork 33 is provided for setting the flask b at both end portions thereof to rotate laterally about a vertical axis, said rotary fork 33 being arranged on the base 4, and a green sand supplying station A and a molding station B, arranged respectively at positions leaving 180 degrees therebetween, it becomes possible to progress a sand filling process and a molding process simultaneously, so that its productivity may be increased.

Thus, the present invention has obtained the following advantages.

Namely, with the pressures caused by a dead load of the pressure plate and by expanding the air spring means as well as the vibration force of the vibration motor which are propagated to the green sand in the flask or with the complex forces of the vibration which are propagated to the pattern via the upper frame, the intermediate frame and the lower frame, it becomes possible to make a green sand mold of sufficient hardness in a short time notwithstanding it generates a small surface pressure, and further it may obtain an advantage economically that manufacturing costs of the molding machine can be lowered since the machine does not necessitate accurate and big oil cylinders (or air cylinders).

Furtheremore, in spite of compression molding of green sand utilizing mainly vibration, it becomes possible to intercept propagation of the vibration to a floor, and so it is advantageous that a bad influence of vibration to an operator and other implements may be prevented.

Other advantages in detail of this invention are as described hereinbefore.

BRIEF DESCRIPTION OF THE DRAWINGS

The drawings show an embodiment of an automatic vibration molding machine for green sand according to the present invention in which.

DETAILED DESCRIPTION OF THE PREFERRED EMBODIMENT

A preferred embodiment of an automatic vibration molding machine for green sand according to this invention will be described in detail with reference to the drawings.

Figure 1:
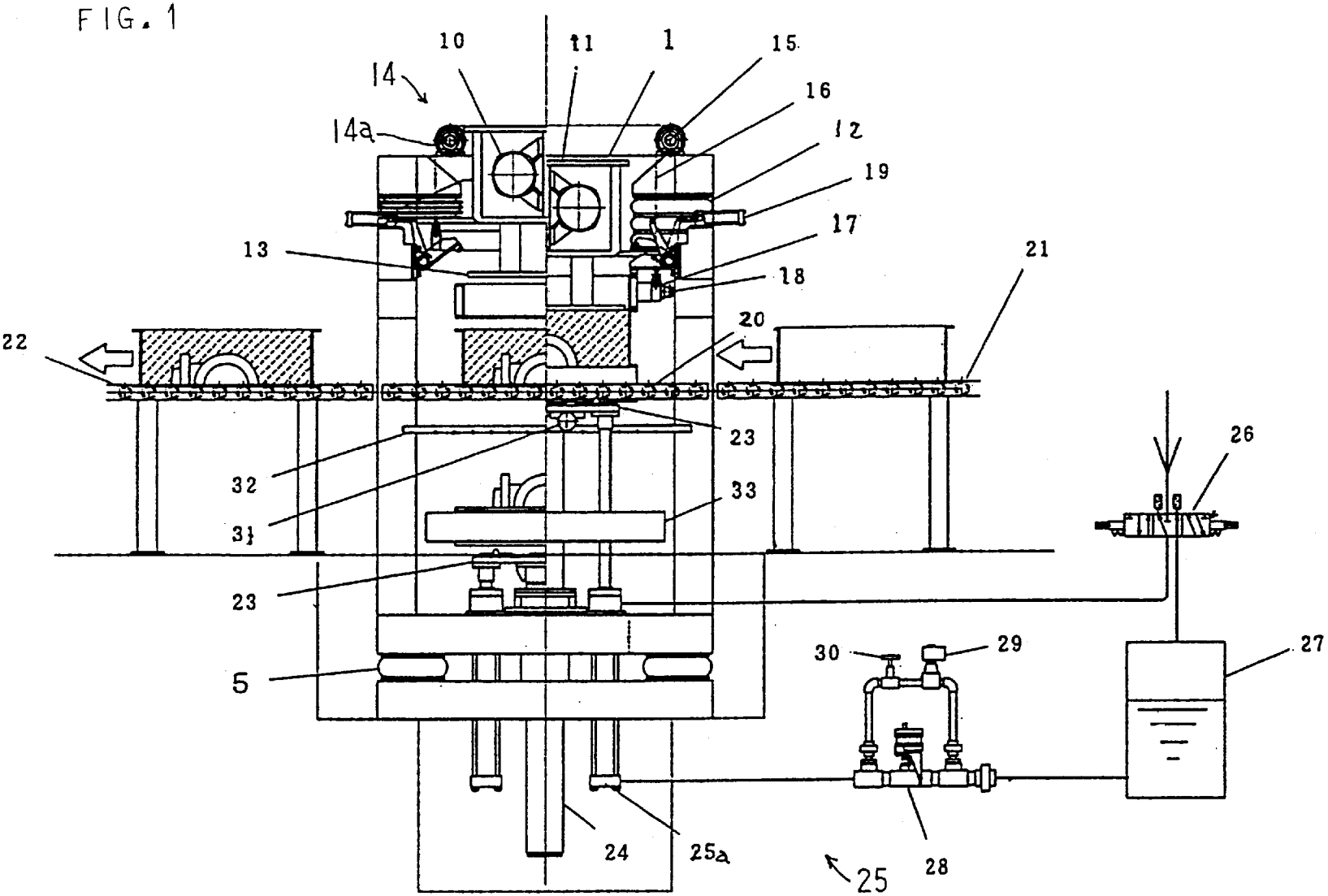
FIG. 1 is a front view of the automatic vibration molding machine for green sand partially broken away.
Figure 2:
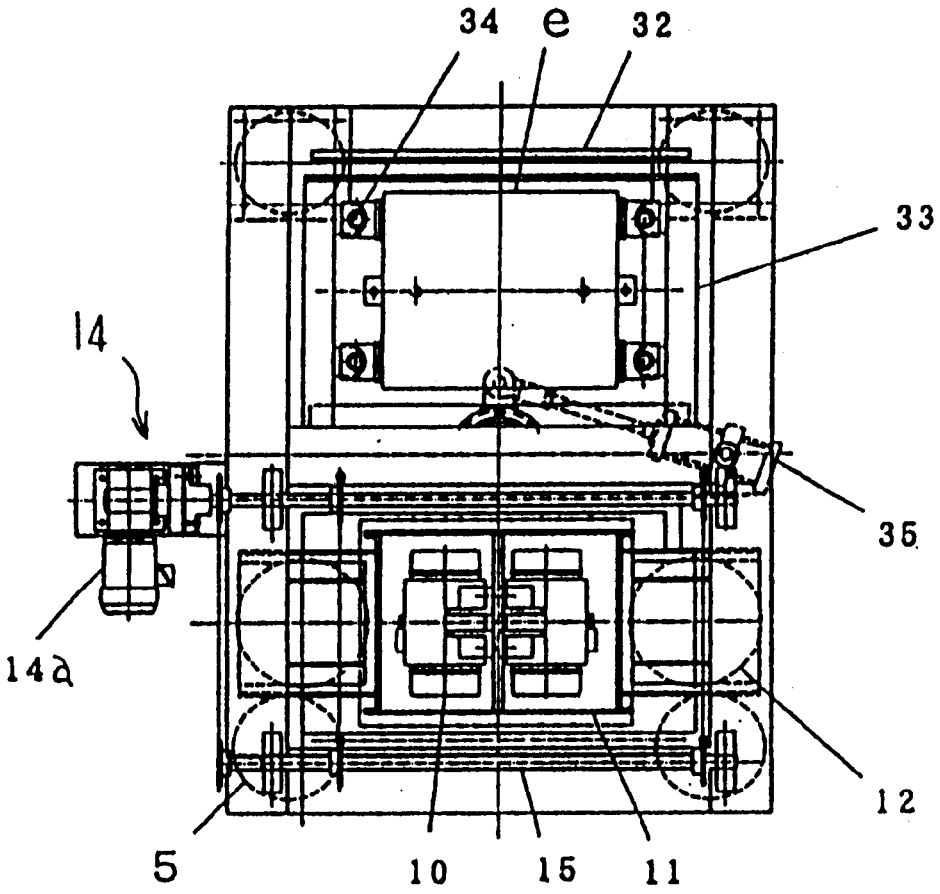
FIG. 2 is a plan view of the automatic vibration molding machine for green sand.
Figure 3:
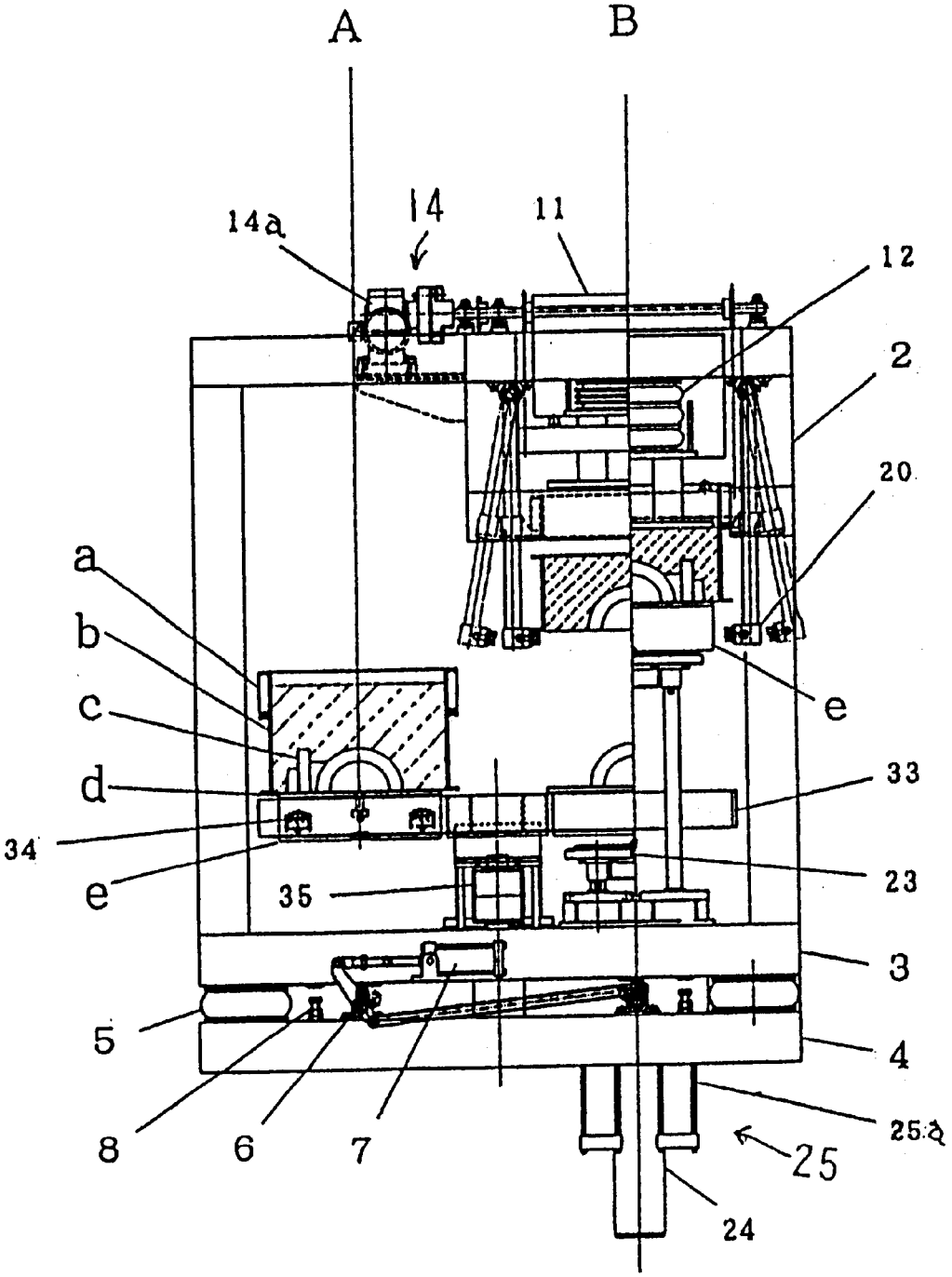
FIG. 3 is a side view of the automatic vibration molding machine for green sand partially broken away.
Figure 4:
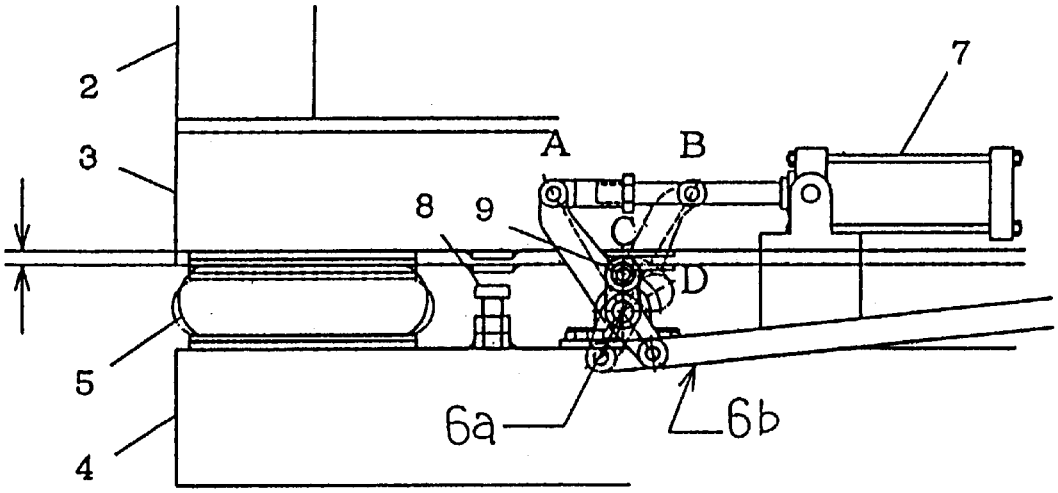
FIG. 4 is an enlarged side view of an essential portion of a frame stabilizing device of the automatic vibration molding machine for green sand partially broken away.
Figure 5:
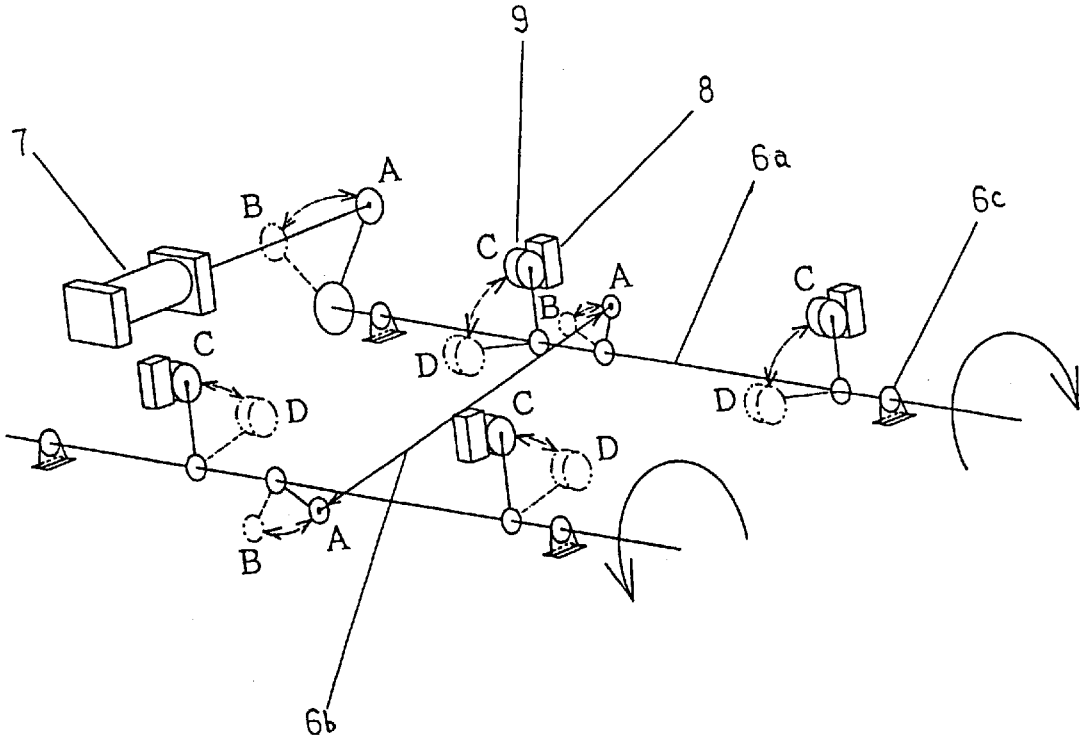
FIG. 5 is a descriptive view showing the operation of the frame stabilizing device of the automatic vibration molding machine for green sand.
Figure 6:
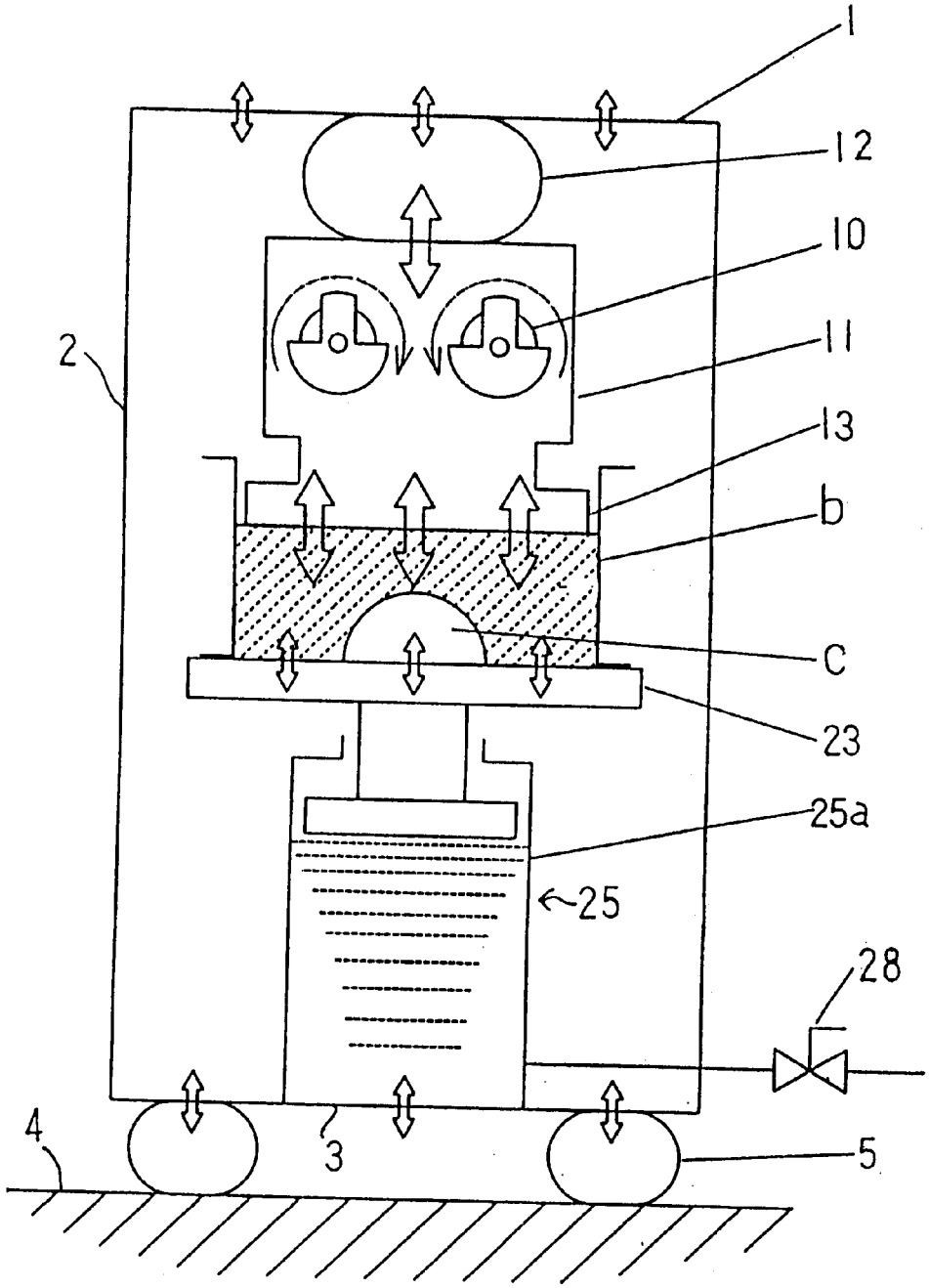
FIG. 6 is a descriptive view showing the molding operation of the automatic vibration molding machine for green sand.

FIG. 1 is a front view of whole of an automatic vibration molding machine for green sand and FIG. 2 is its plan view and FIG. 3 is its side view. FIG. 4 is an enlarged side view of a part of a frame stabilizing device and FIG. 5 is a descriptive view showing the operation of the frame stabilizing device. FIG. 6 is a descriptive view showing vibration molding.

In FIGS. 1 and 3, for convenience sake, the state of completion of draft of a flask and the state of molding are shown separately at right and left portions thereof by separating a vertical dot line in the middle of the drawing to show each parts of the machine in the ascent and descent states.

The automatic vibration molding machine is basically composed such that a flask b is taken into the molding machine by conveying laterally by means of a roller conveyor 21 for the flask and that after completion of molding the flask is taken out by means of another roller conveyor 22 in the other direction. Further, the molding machine provides a rotary fork 33 which is composed to be able to mount the flask b at both ends thereof, and as shown in FIG. 3, a green sand filling station A and a molding station B are arranged at positions of the rotary fork leaving 180 degrees therebetween.

The roary fork 33 is formed to have a shape of a flask and composed to freely ascend and descend together with a ascent and descent table 23, which is mounted on the rotary fork, as well as the flask b, an auxiliary frame a, a pattern c, a pattern plate d and a pattern stool e, by means of ascent and descent cylinders 25 which are arranged therebeneath.

First, it will be explained about the molding-station B.

An upper frame 1 is provided above an intermediate frame 2 which stands on a lower frame 3, and four ascent and descent cylinders 25, are provided beneath the lower frame so as to support four corners of the ascent and descent table 23. Each of the cylinders provides a lock mechanism of oil pressure which pressure is generated by air pressure. The numeral 24 shows a asent and descent guide in the form of cylinder for guiding the ascent and descent operations of the ascent and descent table 23.

20 shows open and close roller hangers which are suspending from the upper frame 1 and arranged at right and left positions as a pair. The hangers are composed such that they hold the lower portions of the flask b after pressure and forming processes, and take the same out. The hangers are operated to close for taking in and holding an empty flask b from the out of the molding machine, and at the time of pressure molding and also at the time of the ascent and descent of the flask b by means of the ascent and descent cylinders 25 with a lock mechanism, the hangers are operated to open. At the lower end of the open and close roller hangers 20, rollers are provided for mounting the flask b and the level of the tracks for the rollers is adjusted to accord with that of a roller conveyor which is arranged outwardly of the molding machine. The open and close roller hangers 20 are pivoted to the upper frame 1 to swing about a lateral axis, and operated by means of a suitable air cylinder which is ordinary well known, but not shown in the drawings. The flask b is, for example, taken in from right side and taken out toward left side, as shown with arrows in FIG. 1.

The numeral 10 shows vibration motors for vibrating a pressure plate 13 which will be referred to hereinafter, and disposed in a vibration head 11. Although the vibration motor 10 comprises an electric motor, but it may use one having other well known constructions. The vibration head 11 is suspended from the upper frame 1 by means of pressure air springs 12 which are expansive and retractive in up and down directions.

The pressure air springs 12 are disposed to face each other as a pair and the vibration motors 10 are also disposed to form a pair with the pressure air springs 12.

A head ascent and descent motor 14*a* is disposed as ascent and descent means 14, for ascending and descending the vibration head 11 by retracting the pressure air springs 12, between the most upper position (non-molding position) where the pressure plate 13 is moved away from the flask b away from the, and the lower position (molding position) where the pressure air springs 12 are extended to compress the green sand in the flask b. Thus, the green sand in the flask b is compressed and molded with the pressures caused by a dead load of each of the vibration head 11 and the pressure plate 13 and the pressure force obtained by expanding the air springs 12 together with the vibration force of the vibration motors 10 as well as the vibration which is propagated to the pattern c from the downward, as will be referred to hereinafter.

The ascent and descent means 14,comprises the head ascent descent motor 14*a,* an ascent and descent sprocket wheel shaft 15, an ascent and descent chain 16, a head ascent and descent frame 17 for the head, and ascent and descent guide rollers 18 rolling the inside surface of the intermediate frame 2. This means 14 is further composed such that when the vibration head 11 is positioned in the most upper position, an empty flask b is substituted for the flask b, which completes its molding, and that the pressure plate 13 is lowered excessively to exceed a depth that the pressure plate 13 compresses the green sand in the lower position, and then make the pressure plate 13 free in its suspending state, so that the pressure plate 13 may follow the displacement of the green sand in a downward direction due to the compression of the green sand.

A frame holding device 19 is composed such that holding levers are rotated with bearings, which are mounted on the intermediate frame 2, so as to open and close by means of an air cylinder. This device prevents vibration of the flask b and the auxiliary frame a at the time of molding in such a state that the tips of the levers contact and hold the upper surface of the auxiliary frame a by means of the air cylinder when the vibration head 11 lowers.

Next, the practical construction of the ascent and descent cylinder 25 with a lock mechanism will be described with reference to the ascent and descent and position fixing of the flask b in the molding station B. An ascent and descent magnetic valve 26 for controlling air for the ascent and descent air for the cylinder, is connected to an air-oil converter 27(tank) to which an oil pipe is connected. The oil pipe connected to a ball valve 28, is also connected to an end of th four ascent and descent cylinders 25*a* (for lift purpose) via a bypass valve 29 and a needle valve 30. The or the ends of each of the four ascent and descent cylinders 25*a* is connected to an air pipe which is controlled by means of the magnetic valve 26.

In FIG. 1, the numeral 31 shows a draft vibrator and the numeral 32 shows a pattern blow. In FIG. 3, 34 show a bracket for receiving a stool, and 35 show a fork rotation cylinder for rotating the rotary fork 33.

Next, it will be explained about the vibration proof air springs 5 and the frame stabilizing device 6 for carrying out the vibration proof function and for fixedly holding the position of the flask b by releasing its vibration proof function.

The vibration proof air spring 5 is positioned fixedly at each of the four corners of the base 4 which is fixed on the floor, and the lower frame 3 is mounted and fixed on the vibration proof air springs 5.

The vibration proof air spring 5 is filled with pressure air which may support whole of the weights of the the lower frame 3 and those of the elements above the lower frame, so as to absorb vibration which is propagated from the upper frame 1 to the floor via the intermediate frame 2, the lower frame 3 and the base 4, so that it may prevent propagation of the vibration to the floor.

The vibration proof air spring 5 has a surplus to still expand in up and down directions (about 5~10 mm).

As shown in FIG. 5 of descriptive view, the frame stabilizing device 6 basically comprises a frame stabilizing cylinder 7, four cam followers 9 and stoppers 9 corresponding thereto, and this device is operatively connected to a link mechanism including a link shaft 6*a*, a connecting rod 6*b*, and bearings 6*c*.

Finally, it will explain about the green sand filling station A.

The green sand is supplied to the flask b from a green sand supplying device (not shown) which is provided separately, and it is possible to desirably carry out additional operations of, for example, setting a tiller, or adding pokect sand, facing sand and back sand.

As the supplying means of the green sand (from a hopper), it is possible to use a well known means. Further, in the green sand filling station A, it is possible to give vibration to the green sand in the flask b, so as to improve tight contact between the green sand and the pattern c in advance.

With such a composition, it becomes possible to carry out simultaneously the supply of the green sand to the flask b and molding by means of the pressure plate 13, in the sand filling station A and also in the molding station B, while changing its position.

Next, it will be described concerning each process of the molding operation.

First, in the green sand filling station A, the pattern c is attached to the pattern plate d, and the pattern plate d is normally connected to the pattern stool e by means of bolts. The pattern stool e is positioned by pins each of which is attached to stool receiving brackets 34 which are attached to the rotary fork 33 to face inwardly and mounted by means of bushes, which are attached to brackets on the sides of the pattern stool. Thus, the pattern stool is in a state that it is rotatable. The flask b and the auxiliary frame a are positioned respectively on the pattern plate d, by means of a bush, and the flask is rotated by means of the rotary fork 33 and moved to the molding station B, after the green sand is filled in the flask b in the green sand filling station A.

Next, in the molding station B, first, the ascent and descent magnetic valve 26 and the ball valve 28 are opened simultaneously for ascent operation, so as to flow pressure air to the upper portion of the air-oil converter 27. Then, the oil in the lower portion of the converter is pressed so that the piston in the ascent and descent cylinder 25*a* as an element of the ascent and descent cylinder means 25 with a lock mechanism, may be raised to start ascending the ascent and descent table 23 along the ascent and descent guide 24.

In the ascent operation, the pattern stool e in the rotary fork 33 is positioned and then ascends in the state that the pins of the ascent and descent table 23 and the bushes of the pattern stool e which are coaxial with the pins, are fit to each other. Then, the ascent and descent magnetic valve 26 and the ball valve 28 are closed simultaneously and the pattern stool stops at an upper limit of stroke of the ascent and descent cylinder 25*a*.

And, in such a state, the oil pipe circuit for the lower portion of the cylinder is interrupted to close its circuit, so that the pressure in the oil pipe may rise over the used air pressure due to the molding pressure and vibration force. However, the ascent and descent table 23 is never descended with lock function due to the oil which is fluid.

Next, it will explain about clamping operation of the flask b. After ascent of the ascent and descent table 23, vibration and noises at the time of molding, may be reduced by pressing the auxiliary frame a of the upper most portion of the ascent and descent table downwardly by means of the frame holding device 19.

And, when it turns to molding steps, the head ascent and descent frame 17 is lowered with the normal rotation of the head ascent and descent motor 14, so that the vibration head 11 mounted on the frame 17 may be lowered. Descent of the vibration head 11 stops in such a state that the pressure plate 13 attached to the lower portion of the head, is placed on the upper surface of the green sand in the auxiliary frame a. Then, the head ascent and descent frame 17 stops after it further descends and separates from the vibration head 11. Therefore, vibration of the vibration head 11 at the time of molding is never propagated directly to the head ascent and descent frame 17.

Next, the frame stabilizing device 6 operates as follows. Namely, the frame stabilizing cylinder 7 operates so that a rod operatively connected to the cylinder may move from A-position to B-position, as shown in FIG. 5, and then disengaged with the cam followers 9 toward D-point, which cam followers support all of the weights of the elements located above the lower frame 3 and including the frame, so that all of the upper elements including the lower frame 3 are descended about 10 mm while slightly deforming the vibration proof air springs 5 under pressure, and thereafter the vibration proof air springs 5 may support the lower frame.

And the vibration motors 10 turn on and supplies air to the upper pressure air springs 12.

The vibration in up and down directions generated by the vibration motors 10, is propagated to the green sand in the flask b from the pressure plate 13 to the flask b via the auxiliary frame a, so as to make the green sand fluid, so that the green sand may be compressed and molded with the vibration force of the vibration motors 10 in combination with the dead load of the vibration head 11 and the pressure force of the pressure air springs 12.

Further, the vibration of the vibration head 11 in molding, is propagated from the upper frame 1 to the intermediate frame 2 via the pressure air springs 12, and then to the ascent and descent cylinder 25 with a lock mechanism via the lower frame 3. As a result, the vibration is propagated to the ascent and descent table 23 which is ascending, and then propagated to the pattern c as a slight vibration, so as to improve filling of the green sand around the pattern c including its shadow portions.

It is sufficient that the total forces of the dead load of the vibration head 11 and the pressure force of the pressure air springs 12 becomes less than 10 $N/cm^2$, and where the total forces increase, there is a tendency to reduce the hardness of the green sand mold.

In the vibrations in up and down directions in molding process, the vibration waves in downward direction are propagated circularly from the green sand in the flask b to the pattern c the pattern plate d, the ascent and descent table 23, the ascent and descent cylinder means 25 with a lock mechanism (the ascent and descent cylinder 25*a*), the lower frame 3, the intermediate frame 2, the upper frame 1 and then to the pressure air springs 12 which is located upwardly. At the time, since the lower frame 3 is supported by the base 4 via the vibration proof air springs 5, the vibration of the lower frame 3 is never propagated to the base 4.

Further, the vibration motors 10 stop for a predetermined time that is set by means of a vibration timer, so as to exhaust the pressure air in the pressure air springs 12 from their rapid-exhaust valves.

Next, it will explain about drafting process of the flask. The head ascent and descent motor 14*a* is generated reversely to start elevation of the head ascent and descent frame 17, so as to lift up the vibration head 11 and stop the same at its upper most limit position. At the same time, the open and close roller hangers 20 are closed to open the frame holding device 19 for releasing clamps of the frame. Then, the frame stabilizing cylinder 7 is actuated to move its cylinder rod from B-point to A-point in FIG. 5, so that the cam followers 9 rotate from D-point to C-point for lifting upo the lower frame 3 for about 10 mm, and then support the lower frame stably.

Next, when the ball valve 28 is opened, the oil in the ascent and descent cylinder 25*a* of the ascent and descent cylinder means 25 with a lock mechanism, returns to the air-oil converter 27, so that the ascent and descent table 23 may start to descend. At the time, the air in the upper portion of the air-oil converter 27 becomes to exhuast through the ascent and descent magnetic valve 26.

Then, in the beginning of descent of the ascent and descent table 23, the auxiliary frame b as the upper most portion of the ascent and descent table is supported by brackets which are attached to the insides of the suspending bars of the open and close roller hangers 20, and the auxiliary frame is separated from the flask b and free in the air in a suspended state.

The ball valve 28 is closed and the bypass valve 29 is also closed just before the state that the lower end of the flask b, which continues to descend, contact the rollers of the open and close roller hangers 20, so that the lowering speed of the flask may be changed to be slow with a small amount of oil which is adjusted by the needle valve 30, and then continue to descend the flask while generating the draft vibrator 31. The flask b rides on the rollers of the roller hangers 20 and stops, but the pattern c, the pattern plate d and the pattern stool e are continued to descend with a low speed in one unit, so as to carry out the draft of the flask.

The ball valve 28 is opened when the pattern c is placed at a lower position that is sufficiently move away from the flask b, and then the descent side of the ascent and descent magnetic valve 26 is opened to urge the air in the upper portion of the ascent and descent cylinder 25 as the ascent and descent cylinder means 25 with a lock mechanism and change its descent to a rapid speed descent. Then, the draft vibrator 31 stops.

The flask is further lowered and the ball valve is closed again just prior to the state that the pattern stool e rides on the stool receiving brackets of the rotary fork 33, and then the bypass 29 is opened to make its lowering speed, so that the pattern stool e may be ridden on the rotary fork 33 without shock. Then, the ascent and descent table 23 is changed again to be a high speed descent and stops at its lower limit position. Thus, the draft process of the flask is finished.

Next, it will explain about change of the flask. The mold after completion of draft, on the open and close roller hangers is taken out by means of another device and conveyed out of the molding,machine via roller conveyor 22. And, another empty flask b is introduced into a center of the open and close roller hangers 20 by means of another device via the flask take-in roller conveyor 21.

Now, it will explain about setting process of the empty flask. As mentioned above, the ascent and descent table 23 is generated to ascend and in the ascending operation the pattern stool e in the rotary fork 33 is mounted on the ascent and descent table 23, and further the empty flask b is set on the pattern plates d. Further, the ascent and descent table 23 is further raised and an auxiliary framea is set on the empty flask b and then the ascent and descent table 23 stops at its most upper limit position.

The open and close roller hangers 20 is opened at its upper limit position and the ascent and descent table 23 is generated to descend and ride on the rotary fork 33 in such the state that the flask b and the auxiliary flask a are set on the pattern stool e, and then the ascent and descent table stops its lower limit position. And, the pattern plate d is cleaned by ejecting air from a nozzle of the pattern blow 32 within a predetermined time counted from the time of ascending the ascent and descent table 23.

Finally, it will explain about rotation process of the flask change rotary fork. In the above mentioned process, when the green sand filling of the flask b is completed in the station A, rotation of the rotary fork 33 is generated and the sand filled flask is moved to the station B, and the empty flask b is moved to the station A.

What is claimed is:

1. An automatic vibration molding machine for green sand mold comprising;

a plurality of vibration proof springs 5 fixed onto a base 4 which is fixed to a floor, a lower frame 3 set and fixed on the vibration proof springs 5, ascent and descent cylinder means 25 with a lock mechanism fixed to the lower frame 3, an ascent and descent table 23 setting thereon a flask b filled with green sand therein and constructed to go up and down between an upward pressing and forming position and a downward predetermined position, an upper frame 1 disposed via an intermediate frame 2 positioned standingly on the lower frame 3, a vibration head 11 having at least one vibration motor to for vibrating a pressure plate 13 via pressure air spring means 12 expansible and contractible in up and down directions, said vibration head being suspended from the upper frame 1 via a head-ascent and descent frame 17, and ascent and descent means 14 for ascending and descending the vibration head 11 to ascend and descend the pressure plate 13 between an upmost position for separating the pressure plate 13 from the flask b by contracting the pressure air spring means 12 and a descent position for expanding the pressure air spring means 12 to press the green sand, whereby the green sand of the flask b may be compressed and formed by the pressure force of expansion of the pressure air spring means 12 and the vibration force of the vibration motor 10 mounted on the vibration head 11, as well as the vibration which is propagated to a pattern c from the upper frame 1 via the lower frame 3, the ascent and descent cylinder 25, and the ascent and descent table 23.

2. The automatic vibration molding machine as claimed in claim 1, further comprising a frame stabilizing device 6 for changably shifting the lower frame 3 between an ascent position for rigidly supporting the lower frame 3 by expanding the vibration proof air springs 5 upwardly and a descent position for descending the lower frame 3 at the time of molding so as to flexibly support the lower frame 3 by means of the vibration proof air springs 5, when the flask b is taken in and taken out of the molding machine, wherein said frame stabilizing device 6 comprises a plurality of cam followers 9 for supporting the lower frame 3 from the beneath thereof, a frame stabilizing cylinder 7 operatively connected to the cam followers 9 to rotate the cam followers 9, and said cam followers 9 are arranged along the sides of the lower frame 3 which are opposite to each other, so as to rotate in opposite directions each other.

3. The automatic vibration molding machine as claimed in claim 1, wherein the ascent and descent cylinder means 25 with a lock mechanism ascends with oil by means of an air-oil converter 27, and is locked by means of a ball valve 28 as the valve is closed.

4. The automatic vibration molding machine as claimed in claim 2, wherein the ascent and descent cylinder means 25 with a lock mechanism ascends with oil by means of an air-oil converter 27, and is locked by means of a ball valve 28 as the valve is closed.

5. The automatic vibration molding machine as claimed in claim 1 further comprising a rotary fork 33 for setting the flask b at both end portions thereof to rotate laterally about a vertical axis, said rotary fork 33 being arranged on the base 4, and a green sand supplying station A and a molding station B, arranged respectively at positions leaving 180 degrees therebetween.

6. The automatic vibration molding machine as claimed in claim 2, further comprising a rotary fork 33 for setting the flask b at both end portions thereof to rotate laterally about a vertical axis, said rotary fork 33 being arranged on the base 4, and a green sand supplying station A and a molding station B, arranged respectively at positions leaving 180 degrees therebetween.

7. The automatic vibration molding machine as claimed in claim 3, further comprising a rotary fork 33 for setting the flask b at both end portions thereof to rotate laterally about a vertical axis, said rotary fork 33 being arranged on the base 4, and a green sand supplying station A and a molding station B, arranged respectively at positions leaving 180 degrees therebetween.

8. The automatic vibration molding machine as claimed in claim 4, further comprising a rotary fork 33 for setting the flask b at both end portions thereof to rotate laterally about a vertical axis, said rotary fork 33 being arranged on the base 4, and a green sand supplying station A and a molding station B, arranged respectively at positions leaving 180 degrees therebetween.

* * * * *